US005375945A

United States Patent [19]

Cherrington

[11] Patent Number: 5,375,945

[45] Date of Patent: Dec. 27, 1994

[54] METHOD AND APPARATUS FOR THRUSTING A PIPELINE INTO BORE HOLE

[75] Inventor: Martin D. Cherrington, Fair Oaks, Calif.

[73] Assignee: Cherrington Corporation, Sacramento, Calif.

[21] Appl. No.: 17,658

[22] Filed: Feb. 12, 1993

[51] Int. Cl.[5] ..... F16L 1/00

[52] U.S. Cl. ..... 405/184; 175/62; 254/134.3 R; 254/387

[58] Field of Search ..... 405/154, 159, 161, 174, 405/184, 230; 175/61, 62, 347; 254/134.3 R, 134.3 CL, 134.3 SC, 134.5, 325, 327, 387

[56] References Cited

U.S. PATENT DOCUMENTS

| | | | |
|---|---|---|---|
| 3,651,872 | 3/1972 | Smith et al. | 175/62 X |
| 3,656,563 | 4/1972 | Blinne | 175/62 X |
| 3,840,079 | 10/1974 | Williamson | 175/62 X |
| 4,117,895 | 10/1978 | Ward et al. | 405/184 X |
| 4,319,648 | 3/1982 | Cherrington | 405/184 X |
| 4,453,603 | 6/1984 | Voss et al. | 405/184 X |
| 4,501,513 | 2/1985 | Warner et al. | 405/184 |
| 4,925,345 | 5/1990 | McCown et al. | 405/230 X |

FOREIGN PATENT DOCUMENTS

| | | | |
|---|---|---|---|
| 4222798 | 8/1992 | Japan | 405/184 |

*Primary Examiner*—Randolph A. Reese
*Assistant Examiner*—John A. Ricci
*Attorney, Agent, or Firm*—Vinson & Elkins

[57] ABSTRACT

A pipeline is forced into a borehole using a deadman disposed directly in front of the entry to the borehole. A force is generated between the deadman and a collar attached to the pipeline such that the pipeline is forced through the deadman into the borehole. The force may be generated by a cable and sheave combination or through hydraulic cylinders.

19 Claims, 4 Drawing Sheets

METHOD AND APPARATUS FOR THRUSTING A PIPELINE INTO BORE HOLE

TECHNICAL FIELD OF THE INVENTION

This invention relates in general to horizontal drilling, and more particularly to a method and apparatus for thrusting a pipeline into a horizontal bore hole.

BACKGROUND OF THE INVENTION

Underground conduits are widely used for the transmission of fluids, such as in pipelines and the like, as well as for carrying wires and cables for the transmission of electrical power and electrical communication signals. While the installation of such conduits is time-consuming and costly for locations where the earth can be excavated from the surface, routing of such conduits becomes more difficult where surface excavation cannot be performed due to the presence of surface obstacles through which the excavation cannot easily precede. Such surface obstacles include highways and railroads and rivers.

A method for installing underground conduits is disclosed in U.S. Pat. No. 4,679,673, issued Jul. 14, 1987, assigned to Cherrington Corporation, which is incorporated by reference herein. This patent discloses a method of forming an enlarged arcuate bore and installing a conduit therein, beginning with the directional drilling of a pilot hole between surface locations and under a surface obstacle, such as a river. Following the drilling of the pilot hole, a reamer is pulled with the pilot drill string from the exit opening toward the entry opening in order to enlarge the pilot hole to a size which will accept the conduit or pipe.

Inserting the pipe in the bore hole can be problematic. The pipeline is pulled through the bore hole using a drill string; however, the pipe can lodge into the sides of the bore hole or into a bore hole full of cuttings to an extent that the drill string cannot provide sufficient power to free the pipeline. In such cases, additional impetus must be provided to the pipeline to dislodge it.

FIG. 1 illustrates a previously used method for forcing a pipeline 10 into a bore hole 12. A collar 14 is secured to the pipeline 10. A tractor 16 having a winch 18 is coupled to the collar over cable 20. By pulling cable 20 with winch 18, the pipeline 10 is pulled toward bore hole 12.

Although the method shown in connection with FIG. 1 has been used successfully, a serious problem with this method is the direction in which the pipeline 10 is pulled. Since the pipeline 10 is pulled at an angle toward tractor 16, the pipeline 10 may be driven toward the walls of the bore hole 12, rather than directly down the axis of the hole. Thus, while the method of FIG. 1 generates the desired forward thrust, it also generates an additional undesirable lateral force. This problem can be somewhat alleviated by using two tractors, one on either side of the pipeline 10, to offset the lateral force components. However, in practice, it is difficult to exactly offset the forces, and therefore, undesirable lateral forces which drive the pipe into the sidewalls of the bore hole 12 remain.

Another method to provide impetus to the pipeline 10 is shown in FIG. 2. This method is similar to that shown in FIG. 1, with the addition of a sheave 22 coupled to collar 14 and a deadman 24 mounted in the ground. Cable 20 is routed around sheave 22 and attached to deadman 24. Again, as the cable 20 is retracted onto winch 18, a force is applied to pipeline 10 driving it into the bore hole 12. Use of the sheaves 22 is advantageous because of the multiple forces applied to the pipeline. However, this arrangement suffers from the same problem as the method of FIG. 1, since lateral forces which pull the pipeline 10 toward the sidewalls of the bore hole 12 are created. Further, it is difficult to control or balance two or more power units for a uniform pull on the pipeline 10.

FIG. 3 illustrates a third method for providing thrust to a pipeline 10. In this method, a tractor 16 with a crane 26 is used to drive the pipeline 10 into the bore hole 12. From this view, it can be seen that the drill string 28, which is coupled to the pipeline 10, is also used to pull the pipeline 10 into the bore hole 12. While this method for driving the pipeline 10 can be used to reduce the angle at which the force is applied, thereby reducing the lateral forces on the pipeline 10, the stability of the tractor 16 with the crane 26 is attached, thereby reducing the force which may be applied to the pipeline 10.

Therefore, a need has arisen in the industry for an improved method and apparatus for thrusting a pipeline into a bore hole.

SUMMARY OF THE INVENTION

In accordance with the present invention, a method and apparatus is provided for thrusting a pipeline into a bore hole which eliminates substantial problems with prior solutions.

In the present invention, a frame is disposed in front of a bore hole, such that the pipeline is disposed through the frame. A collar is attached to the pipe and a force generating means is coupled between the frame and collar to drive the pipeline into the bore hole. In the preferred embodiment, the frame comprises an A-frame coupled to the collar using a plurality of sheaves about which a cable is routed. The cable may be pulled by a tractor or other device, resulting a direct force being applied to the pipeline to drive it into the bore hole.

The present invention provides significant advantages over the prior art. First, the forces on the pipeline are significantly in line with the path through the hole. Second, the invention can incorporate various mechanisms for providing impetus to the pipe, such as a hydraulic cylinder or a tractor coupled to the collar with a cable through an arrangement of sheaves on the collar and frame. The invention allows a relatively high, controlled force to be used while maintaining safe operation. Further, the force can be reversed to pull the pipe from the borehole. Third, the invention is reusable and can be easily broken down for shipping. Fourth, the invention can allow the thrusting force to be coordinated with the drill rig. Fifth, the force can be applied close to the bore hole. Sixth, the invention is capable of working with the pipe at a high entry angle.

BRIEF DESCRIPTION OF THE DRAWINGS

For a more complete understanding of the present invention, and the advantages thereof, reference is now made to the following descriptions taken in conjunction with the accompanying drawings, in which.

Figure 5A:
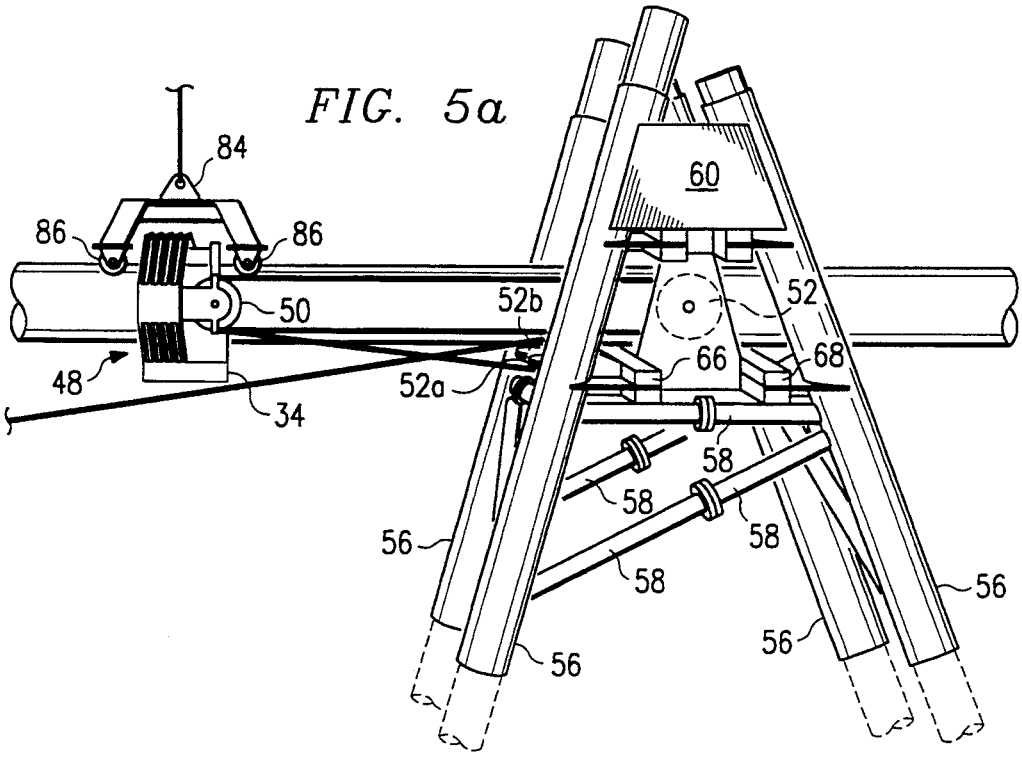
Figure 5B:
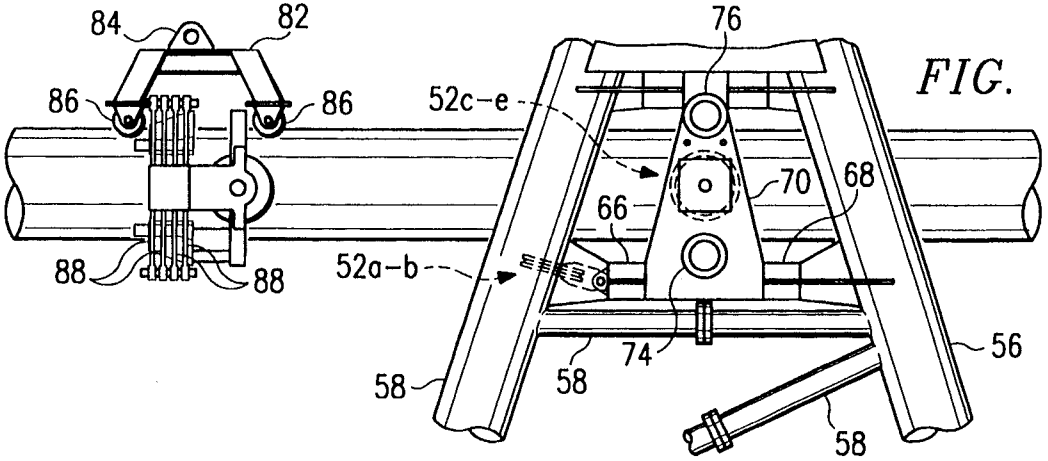
Figure 5C:
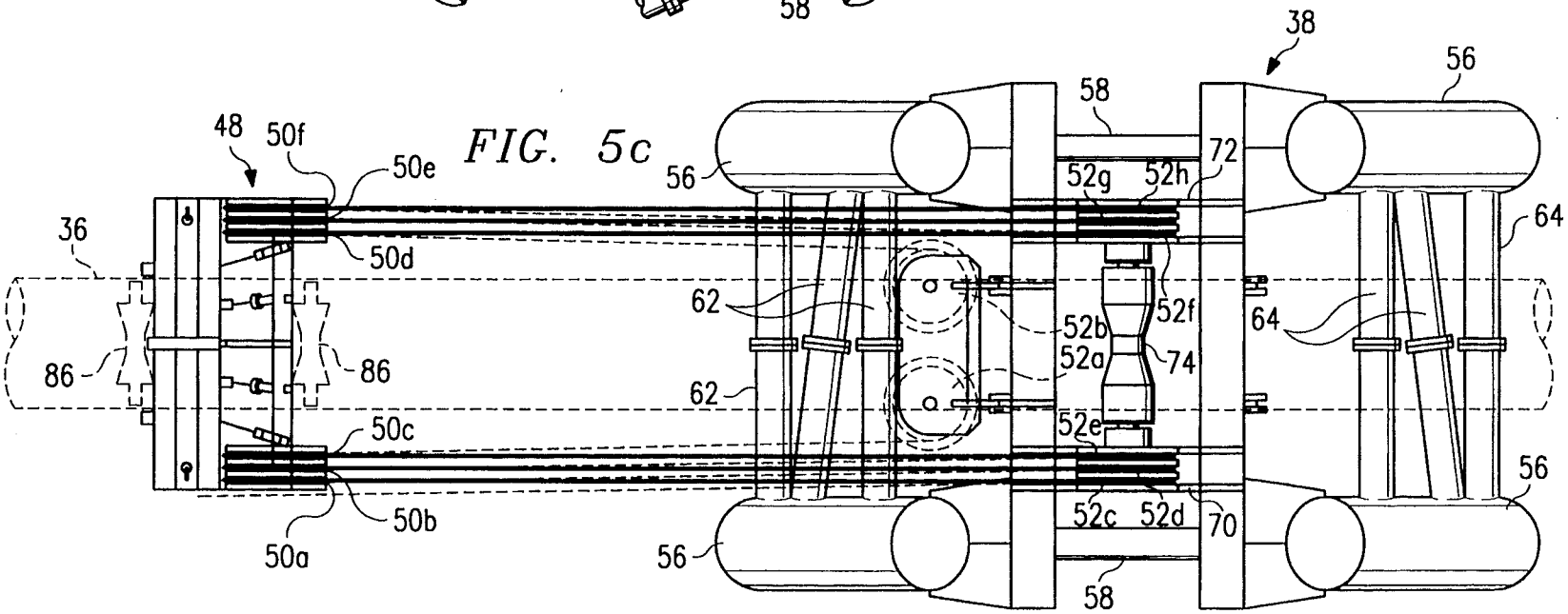
Figure 6:
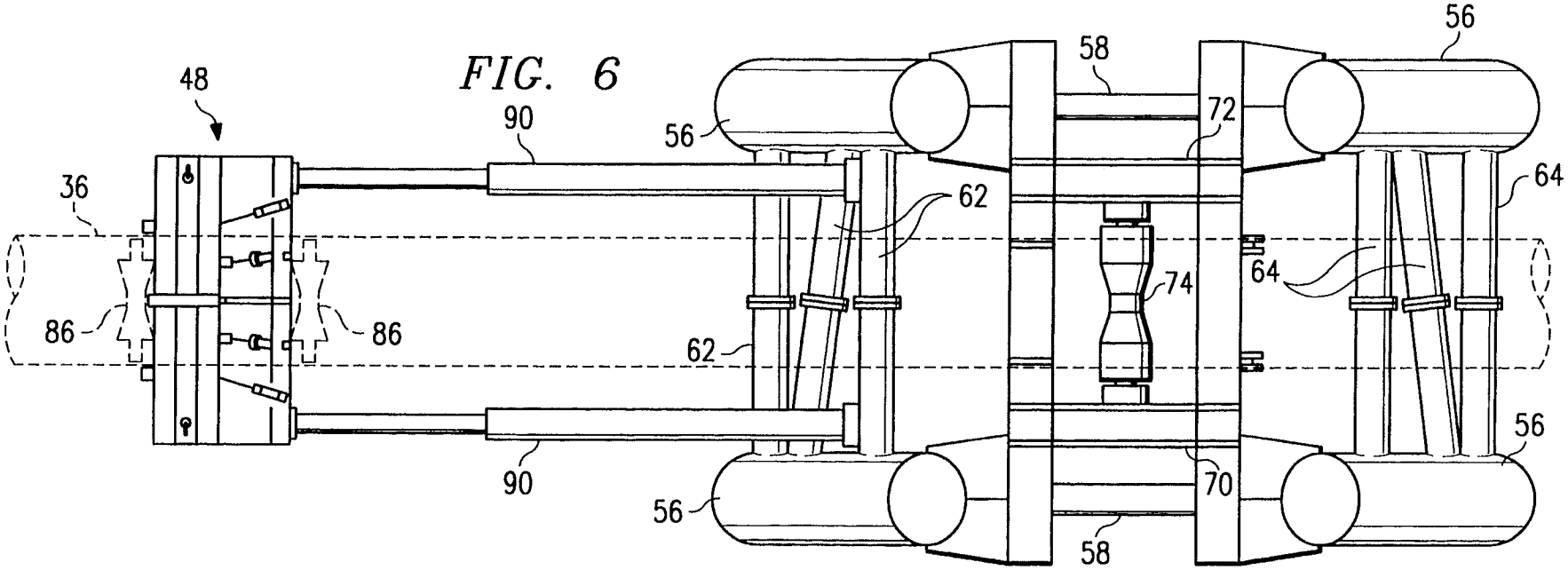
Figure 7:
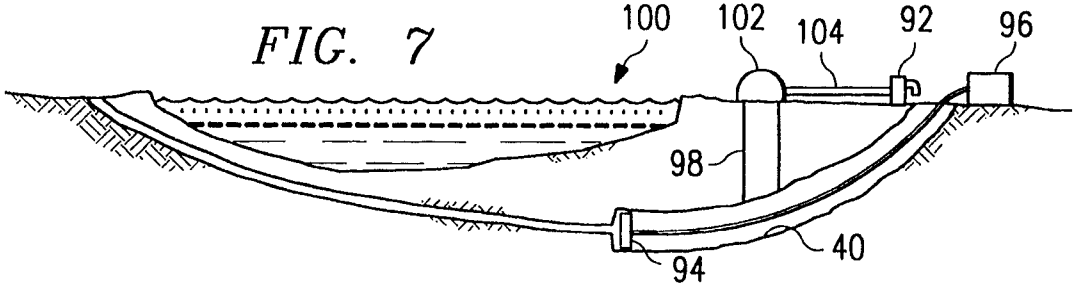

FIGS. **4*a*–4*b*** illustrate top and side views of the preferred embodiment of the present invention;

FIGS. 5a–5c illustrate perspective, side, and top views of A-frame deadman used in the present invention:

FIG. 6 illustrates a top view of a second embodiment of the present invention using hydraulic cylinders; and FIG. 7 illustrates a preferred embodiment for recovering drilling mud while forming the bore hole.

DETAILED DESCRIPTION OF THE INVENTION

The preferred embodiment of the present invention and its advantages are best understood by referring to FIGS. 4–7 of the drawings, like numerals being used for like and corresponding parts of the various drawings.

Figure 1:
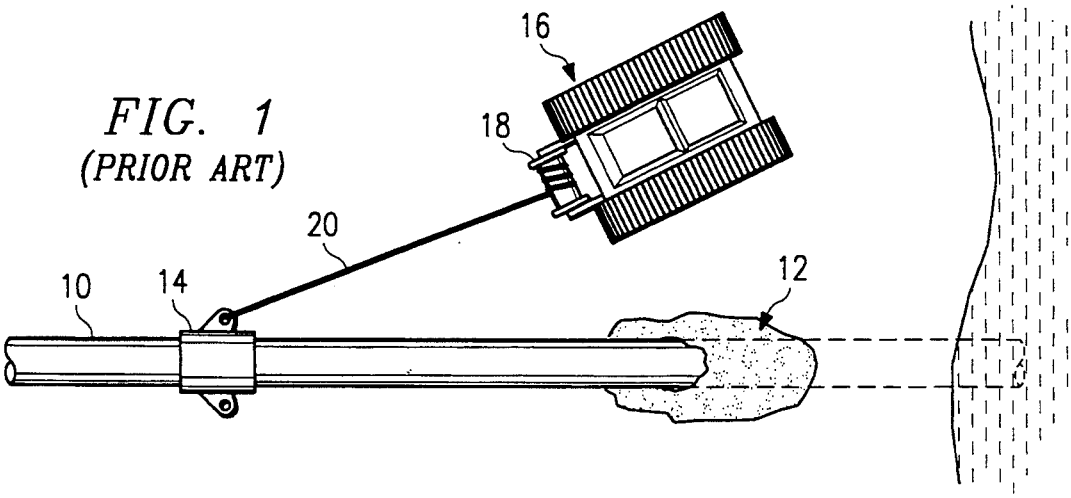
FIG. 1 (PRIOR ART)
FIGS. 1–3 illustrate previously used methods of thrusting a pipeline into a bore hole.
Figure 2:
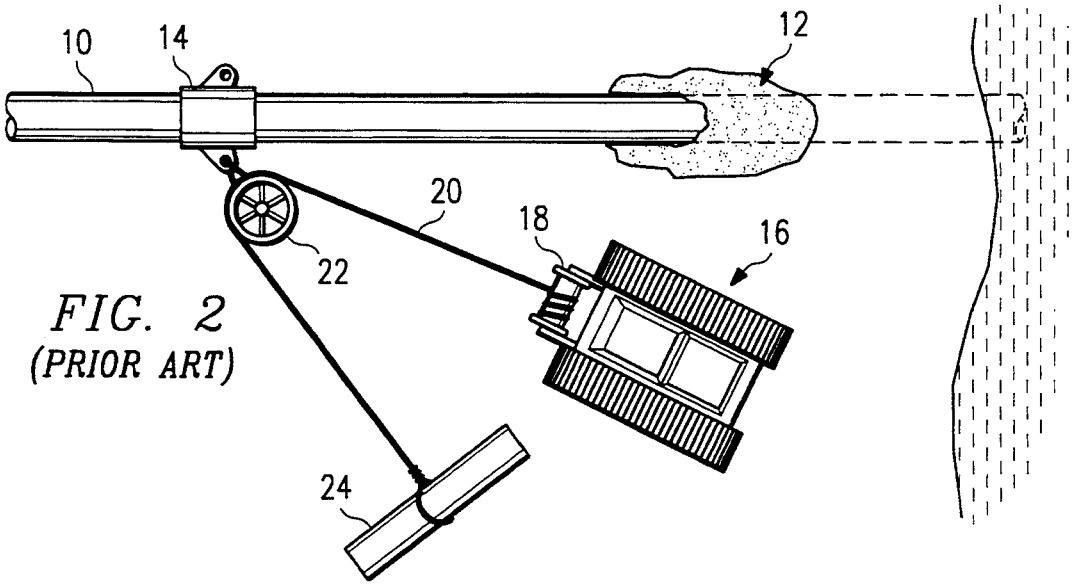
FIG. 2 (PRIOR ART)
Figure 3:
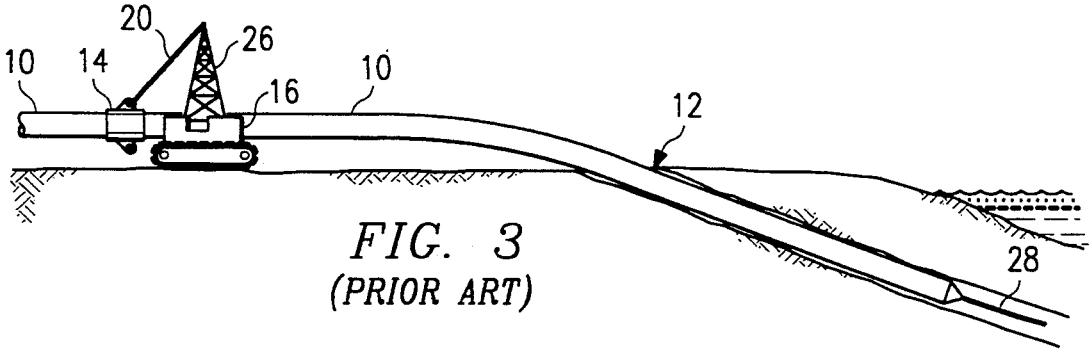
FIG. 3 (PRIOR ART)
Figure 4A:
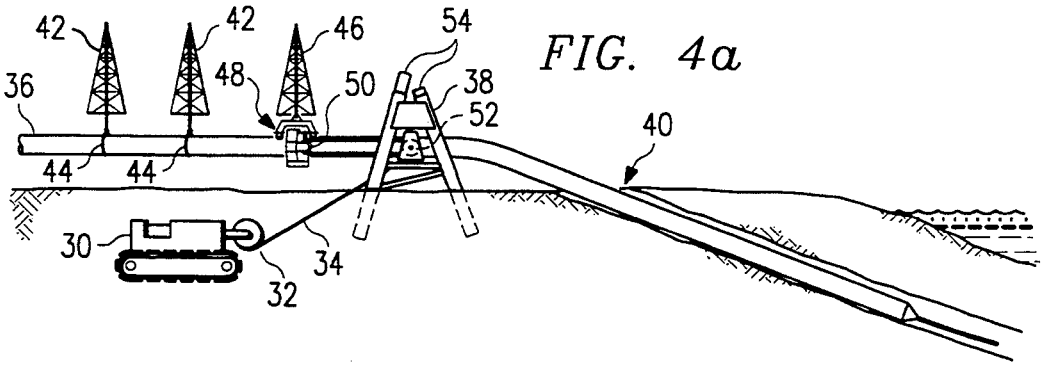
Figure 4B:
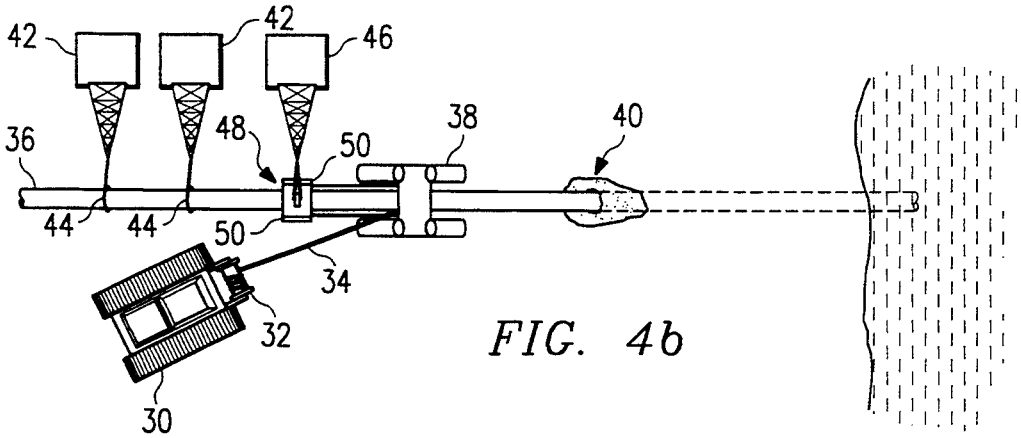

FIGS. 4a–4b illustrate side and top views of the present invention. A tractor 30 having winch 32 uses a cable 34 to drive a pipeline 36 into a borehole. The pipeline 36 is disposed through a cavity in an A-frame deadman 38 which is positioned directly in line with the entry to borehole 40. Pipeline 36 is suspended above ground by cranes 42 having slings 44 wrapped around pipeline 36. Collar 48, which is secured to pipeline 36, has plurality of sheaves 50 rotatably mounted thereon. Similarly, deadman 36 has a plurality of sheaves 52 rotatably mounted thereon. Cable 34 is threaded around sheaves 50 and 52, such that a force exerted on cable 34 by winch 32 or tractor 30 will create a force on collar 48 which directly pulls the pipeline 36 through the deadman 38. Thus, in the embodiment shown in FIGS. 4a–4b, a force exerted on cable 34 would drive the pipeline into borehole 40.

In operation, the collar 48 may be placed on either side of deadman 38, depending on whether the pipeline 36 is to be pushed into borehole 40 or removed from borehole 40. The deadman 38 is secured into the ground by piles 54. The force on cable 34 is translated by sheaves 50 and 52 into a direct translational force on collar 48. The force drives pipeline 36 through the deadman 38. Hence, even though the force vector created by cable 34 is at an angle to pipeline 36, the resulting force on collar 48 is directly in-line with the desired movement of pipeline 36.

FIGS. 5a–5c illustrate more detailed views of deadman 38 and collar 48. FIG. 5a illustrates a perspective view of deadman 38 and collar 48, FIG. 5b illustrates a partial side view of deadman 38 and collar 48 and FIG. 5c illustrates a top view of deadman 38 and collar 48. Deadman 38 includes four tubular legs 56. Respective front and back legs are connected by cross-supports 58 and cross-member 60. Frontal supports 62 couple the pair front legs 56 and rear supports 64 couple rear legs 56. Cross bars 66 and 68 are disposed across front and rear legs, respectively. Horizontally aligned sheaves 52a–b are coupled to cross bar 64. Vertical sheave housings 70 and 72 are coupled across cross bars 66 and 68. Vertical sheaves 52c–e are rotatably mounted in sheave housing 70 and vertically aligned sheaves 52f–h are mounted in sheave housing 72. Bottom roller 74 and top roller 76 are rotatably mounted between sheave housings 70 and 72. Collar 48 includes sheave housing 78 for containing sheaves 50a–c and sheave housing 80 containing sheaves 50d–f. Upper support 82 includes ring 84 for connection to the crane cable and rollers 86 for moving the collar along the pipeline 36. Clamps 88 attach to the pipe 36.

Cable 34 is coupled to the sheaves 50 and 52 as follows. The cable 34 from winch 32 is wrapped counterclockwise around sheave 52c in a one-half arc. The cable extends from the top of sheave 52c to the top of collar sheave 50a. The cable is wrapped one-half arc around sheave 50a and extended to the bottom of from sheave 52d. The cable 34 is wrapped one-half arc around sheave 52d where it extends from the top of sheave 52d to the top of sheave 50b. The cable wraps one-half arc around sheave 50b and extends to sheave 52e. The cable is wrapped one-half arc around sheave 52e to return to sheave 50c. The cable is wrapped one-half arc around sheave 50c and extended around horizontal sheaves 52a and 52b. The cable is wrapped around sheaves 50d–f and 52f–h in mirror image to the arrangement around sheaves 50a–c and 52c–e. The end of cable 34 is coupled to the deadman 38. In the preferred embodiment, a tension gauge is coupled between the end of cable 34 and deadman 38 so that the force on the deadman 38 may be monitored.

In operation, the collar 48 is securely fastened to pipeline 36. The pipeline 36 extends through the cavity 71 in deadman 38 between top and bottom rollers 72 and 74 which provide support to the pipeline. As the tractor creates a force on cable 34, sheaves 50 are drawn toward sheaves 52, thereby drawing pipeline 36 through the cavity 71 in deadman 38. Since the force between sheaves 50 and 52 is almost directly in line with the pipeline 36, all force directed to the pipeline 36 is in the desired direction.

It should be noted that while FIGS. 5a–5c illustrate the preferred configuration of sheaves 50 and 52, it would be possible to use more or less the sheaves disposed in other arrangements to provide the same direct force on pipeline 36.

FIG. 6 illustrates a second embodiment of the present invention, wherein hydraulic cylinders 90 are placed between the deadman 38 and collar 48. The hydraulic cylinders are generally used to provide a force which pushes collar 48 away from deadman 38. As in FIGS. 5a–5c, the force applied to collar 48 is directly in line with pipeline 36. The hydraulic cylinders 90 may be used in place of the sheave arrangement shown in FIGS. 5a–5c, or may be used in an A-frame which also provides the sheaves 50 and 52. The hydraulic cylinders 90 are particularly useful where a smooth, steady force is required. Other drivers, in addition to the cable/-sheave and hydraulic cylinder arrangements shown herein, may also be used to drive the pipeline, as would be known to one skilled in the art.

The arrangement shown in FIGS. 4–6 provides significant advantages over the prior art. The A-frame deadman 38 can be securely anchored into the ground, but is also easily moveable by removing piles 54. Deadman 38 can be used to force pipeline 36 either into or out of the hole, without requiring movement of the deadman 38, simply by moving collar 48. Most importantly, a direct force may be applied to the pipeline 36 to drive it into or out of the hole 40.

FIG. 7 illustrates a preferred embodiment of forming the borehole 40 which allows drilling mud to be more easily removed. As the borehole 40 is extended into the subsurface drilling mud is forced into the borehole 40 through pump 92 as reamer 94 is rotated by drill 96. As the borehole 40 becomes longer, removal of the drilling mud becomes more difficult. Hence, a secondary hole 98 is formed near the obstacle (in this case, river 100) from which the drilling mud may be recovered via air lift 102. The drilling mud is returned to pump 92 through pipeline 104. Typically, the drilling mud is recycled for purification before being returned to hole 40.

Although the present invention and its advantages have been described in detail, it should be understood that various changes, substitutions and alterations can be made herein without departing from the spirit and scope of the invention as defined by the appended claims.

What is claimed is:

1. Apparatus for applying force to a pipeline in a borehole, comprising:

a collar attached to the pipeline;

a frame for positioning in front of said borehole, said frame having a cavity through which the pipeline may be disposed, said frame comprising a plurality of sleeve members operable to receive corresponding piles therethrough to fixedly attach the frame to the ground; and a driver for applying a force between said frame and said collar to drive the pipeline through the cavity.

2. The apparatus of claim 1 and further comprising at least one roller to guide the pipeline through the frame.

3. The apparatus of claim 1 wherein said frame comprises an A-frame.

4. The apparatus of claim 1 wherein said driver comprises:

one or more sheaves mounted on said collar;

one or more sheaves mounted on said frame; and a cable disposed about said collar sheaves and said frame sheaves such that a force applied to one end of the cable pulls the collar directly toward the frame.

5. The apparatus of claim 4 wherein a force gauge is coupled between said cable and said frame to indicate the force applied to the frame.

6. The apparatus of claim 4 wherein a force gauge is coupled between said cable and said frame to indicate the force applied to the frame.

7. The apparatus of claim 1 wherein said driver comprises one or more hydraulic cylinders coupled between said frame and said collar to push said collar directly away from said frame.

8. The apparatus of claim 1 wherein said sleeve members comprise first and second pairs of sleeve members, each pair of sleeve members having first and second sleeve members oriented diagonally toward one another.

9. The apparatus of claim 8 and further comprising at least one support member coupled between said first and second sleeve members of each of said first and second sleeve member pairs.

10. The apparatus of claim 9 and further comprising at least one support member coupled between respective sleeve members of said first and second pairs.

11. Apparatus for applying force to a pipeline in a borehole, comprising:

a collar attached to the pipeline;

a frame having a cavity through which the pipeline may be disposed for positioning in front of said borehole, said frame comprising:

first and second pairs of sleeve members, each pair of sleeve members having first and second sleeve members oriented diagonally toward one another through which piles may be driven into the ground;

at least one support member coupled between said first and second sleeve members of each of said first and second sleeve member pairs; and at least one support member coupled between respective sleeve members of said first and second pairs; and a driver for applying a force between said frame and said collar to drive the pipeline through the cavity.

12. The apparatus of claim 11 wherein said driver comprises one or more hydraulic cylinders coupled between said frame and said collar to push said collar directly away from said frame.

13. The apparatus of claim 11 wherein said driver comprises:

one or more sheaves mounted on said collar;

one or more sheaves mounted on said frame; and a cable disposed about said collar sheaves and said frame sheaves such that a force applied to one end of the cable pulls the collar directly toward the frame.

14. A method of moving a pipeline disposed within a borehole, comprising the steps of:

attaching a collar to the pipeline;

positioning a frame in front of said borehole;

securing the frame to the ground by driving piles though a plurality of sleeve members forming the frame;

disposing the pipeline through a cavity in said frame; and applying a force between said collar and said frame to drive said pipeline through said cavity.

15. The method of claim 14 wherein said force applying step comprises the step of tensioning a cable disposed around sheaves coupled to said frame and said collar.

16. The method of claim 14 wherein said force applying step comprises the step of expanding at least one hydraulic cylinder coupled between said frame and said collar to drive said collar away from said frame.

17. The method of claim 14 and further comprising the step of guiding the pipeline through said frame with one or more rollers.

18. Apparatus for applying force to a pipeline in a borehole, comprising:

a collar attached to the pipeline;

a frame for positioning in front of said borehole, said frame having a cavity through which the pipeline may be disposed; and a driver for applying a force between said frame and said collar to drive the pipeline through the cavity, said driver comprising:

one or more sheaves mounted on said collar;

one or more sheaves mounted on said frame; and a cable disposed about said collar sheaves and said frame sheaves such that a force applied to one end of the cable pulls the collar directly toward the frame.

19. A method of moving a pipeline disposed within a borehole, comprising the steps of:

attaching a collar to the pipeline;

positioning a frame in front of said borehole;

disposing the pipeline through a cavity in said frame; and applying a force between said collar and said frame to drive said pipeline through said cavity by tensioning a cable disposed around sheaves coupled to said frame and said collar.

* * * * *